United States Patent [19]

Matsuyama et al.

[11] Patent Number: 4,813,906

[45] Date of Patent: Mar. 21, 1989

[54] PIVOTABLE RUNNING TOY

[75] Inventors: Yasushi Matsuyama; Koichi Sasagawa, both of Tokyo, Japan

[73] Assignee: Tomy Kogyo Co., Inc., Tokyo, Japan

[21] Appl. No.: 125,830

[22] Filed: Nov. 25, 1987

Related U.S. Application Data

[63] Continuation of Ser. No. 839,945, Mar. 17, 1986, abandoned.

[30] Foreign Application Priority Data

Oct. 19, 1985 [JP] Japan ..... 60-160523[U]

[51] Int. Cl.[4] ..... A63H 17/00

[52] U.S. Cl. ..... 446/457; 446/462; 180/14.1

[58] Field of Search ..... 446/457, 462, 431; 180/14.1, 24.08, 24, 22

[56] References Cited

U.S. PATENT DOCUMENTS

| | | | |
|---|---|---|---|
| 3,161,172 | 12/1964 | Kassbohrer | 180/24 X |
| 3,540,151 | 11/1970 | Ishida | 446/462 X |
| 4,674,585 | 6/1987 | Barlow et al. | 180/14.1 |
| 4,730,684 | 3/1988 | Pedersen | 180/24.08 X |

FOREIGN PATENT DOCUMENTS

| | | | |
|---|---|---|---|
| 517078 | 4/1921 | France | 180/24.08 |
| 2154152A | 9/1985 | United Kingdom . | |

*Primary Examiner*—Mickey Yu

*Attorney, Agent, or Firm*—Staas & Halsey

[57] ABSTRACT

A running toy having a chassis with a plurality of pivotably connected portions and a power source for moving the chassis over a surface including uneven portions and obstructions. Each of the pivotably connected portions of the chassis has mounted thereon gears which engage the gears on an adjacent pivotably connected portion so that a driving force provided by the power source is transmitted to the gears of each of the pivotably connected portions in a manner so as to move the running toy. The gears on each of the pivotably connected portions are mounted so that the gears on adjacent pivotably connected portions remain engaged regardless of the pivotable relationship between adjacent portions of the chassis. At least one of the gears on each of the pivotably connected portions has mounted thereon a hub and drive wheel. Because the chassis comprises pivotably connected portions, the running toy can traverse uneven surfaces and obstacles having a wide variety of heights and inclinations. As the running toy traverses across an uneven surface and surmounts obstacles the chassis deforms to enable the running toy to continue moving; thus, creating interesting shapes for the running toy which capture the interest of a user.

5 Claims, 3 Drawing Sheets

PIVOTABLE RUNNING TOY

This is a continuation of co-pending application Ser. No. 839,945, filed on Mar. 17, 1986, now abandoned.

BACKGROUND OF THE INVENTION

The present invention relates to a toy vehicle; and more particularly, to a toy vehicle which can easily move over uneven surfaces and obstacles.

There is a need for running toys which can move in new and interesting fashions in order to increase a user's interest in the toy. This is especially true for running toys capable of moving over uneven surfaces and obstacles. It is required that a running toy for moving over uneven surfaces and obstacles be capable of surmounting a wide range of obstacles varying in height and inclination. If a running toy cannot easily and interestingly move over a variety of obstacles, then user interest in the toy is easily lost and considerable stress is placed on the toy's drive mechanism which may cause premature toy failure.

SUMMARY OF THE INVENTION

Accordingly, it is an object of the present invention to provide a pivotable running toy capable of easily and interestingly moving over uneven surfaces and obstacles.

It is another object of the present invention to provide a pivotable running toy capable of moving over obstacles having significant height with respect to the height of the toy and having varying degrees of inclination.

It is a further object of the present invention to provide a pivotable running toy capable of moving over uneven surfaces and obstacles by deforming the chassis in an interesting manner.

To achieve the above and other objects of the present invention, the pivotable running toy of the present invention includes a chassis having a plurality of pivotably connected portions; drive means, mounted on the chassis, for providing a drive force; a plurality of drive wheels rotatably mounted on the chassis; and drive force transmission means, operatively connected to the drive means and to the drive wheels, for transmitting the drive force to the drive wheels independent of the pivotable relationship between respective ones of the pivotably connected portions of the chassis.

In a preferred embodiment of the present invention, the chassis comprises a set of pivotably connected portions structured so that adjacent ones of the connected portions engage each other and rotate about an axle on which drive gears are mounted. The connected portions do not need to be connected via an axle, and can be connected via any pivotable type connection such as a universal joint or other gimbal joints. Further, the axle can comprise, for example, a single bar or protrusions from the connected portions shaped so as to enable the drive gear to rotate thereon.

In a preferred embodiment of the present invention, the drive means comprises, for example, a dc electric motor, or a spring type motor energized by winding a spring via pulling a cord or by turning a key. In a preferred embodiment of the present invention the drive means is mounted within one of the connected portions as is the drive means power source which can comprise, for example, batteries. The drive means rotates at least one of the drive gears which is mounted on a connected portion so as to transmit the rotation of the drive means to the remaining drive gears and to the transfer gears. The pivoting of the connected portions of the chassis as the running toy moves across uneven surfaces and over objects deforms the chassis of the running toy so as to create interesting movements and capture the interest of the user.

BRIEF DESCRIPTION OF THE DRAWINGS

The accompanying drawings, which are incorporated in and constitute part of the specification, illustrate an embodiment of the present invention, and together with the following description serve to explain the principles of the invention.

DETAILED DESCRIPTION OF THE PREFERRED EMBODIMENT

Figure 1:
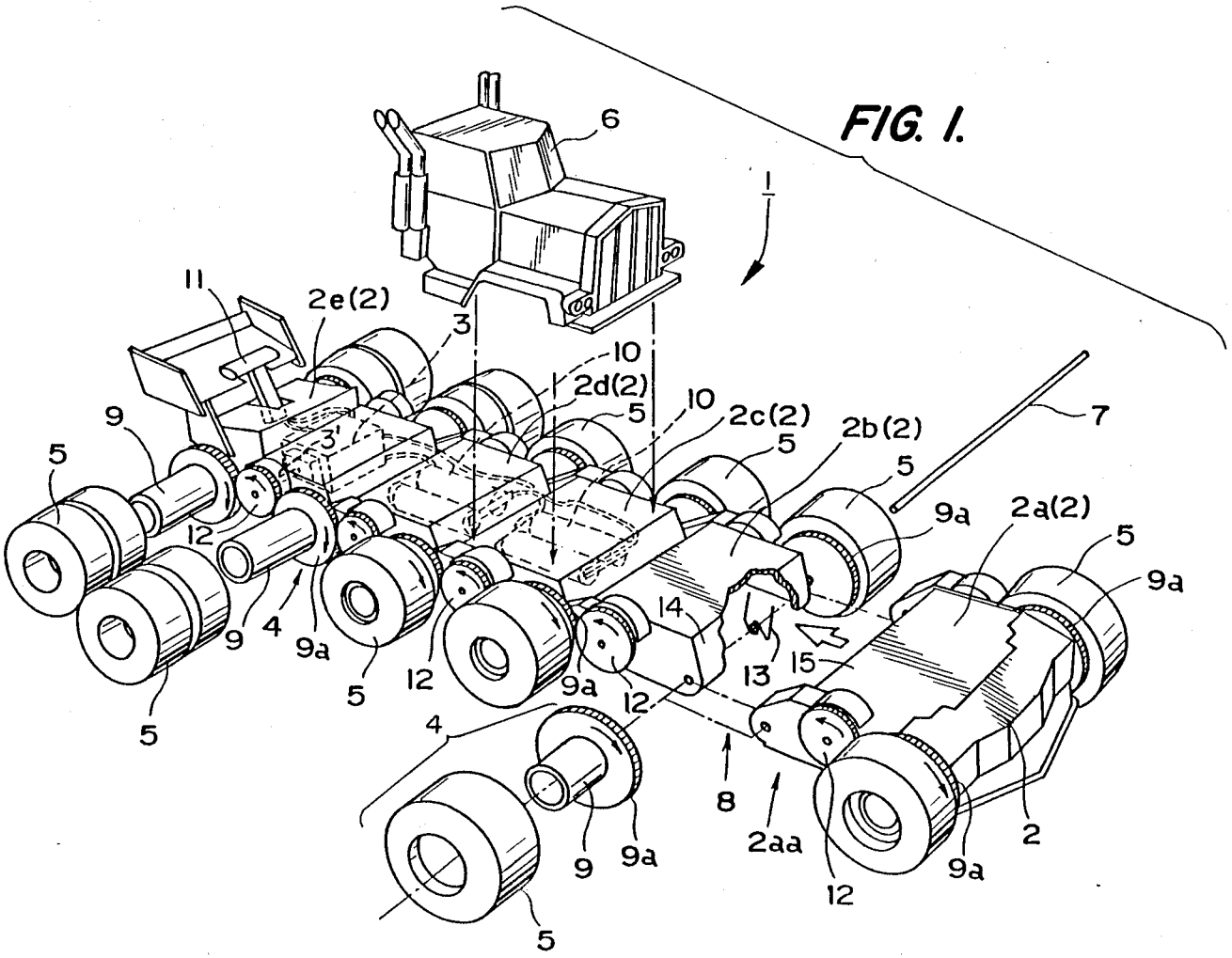
FIG. 1 is an exploded perspective view showing the principal parts of an embodiment of the present invention.

FIG. 1 is an exploded perspective view of an embodiment of the running toy 1 of the present invention having a shape in the form of a sixteen (16) wheel trucks. The running toy 1 comprises a chassis 2 which includes a plurality of pivotably connected portions 2*a*(2), 2*b*(2), 2*c*(2), 2*d*(2) and 2*e*(2).

A drive source 3 is mounted within the connected portion 2*e*(2) and has a shaft 3' for providing the driving force for the running toy 1. The drive source 3 can comprise, for example, a dc motor, a spring motor which is wound either by a hand crank, or, for example, by a cord which is pulled to wind an internal spring.

Figure 3:
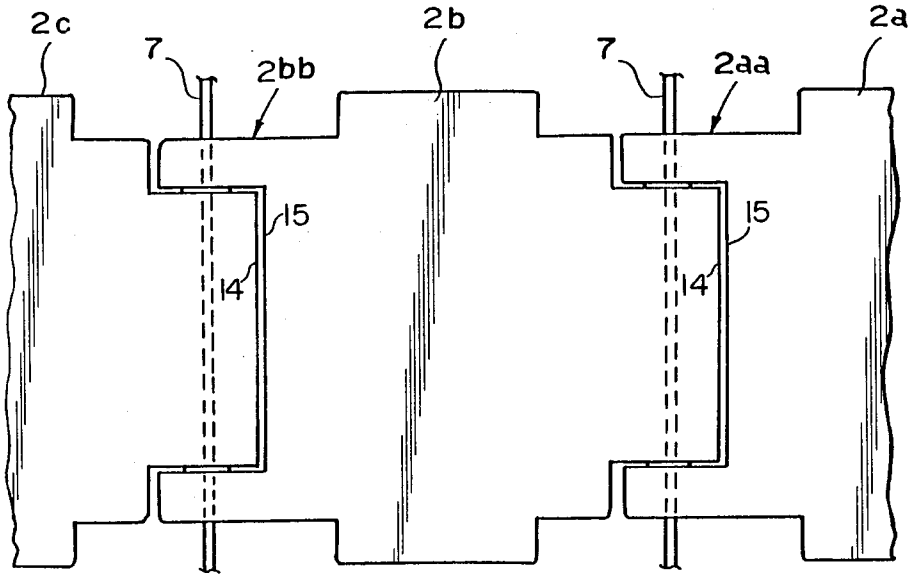
FIG. 3 is a top view of a portion of the chassis of the present invention.

The connected portions 2*a*(2) . . . 2*e*(2) of the chassis 2 are successively coupled by shafts 7 so as to form a chassis capable of being deformed when the running toy 1 travels over either an uneven surface or an obstruction. The connected portions of the chassis 2 include connection points 8 which engage a portion of an adjacent connected portion via, for example, protrusions 2*aa* and 2*bb* such as shown in FIG. 3. In the preferred embodiment of the present invention, adjacent connected portions of the chassis 2 are coupled via a combination of protrusions such as 2*aa* and 2*bb* shown in FIG. 3 and the shaft 7 which fits through openings in both the protrusions and the adjacent connected portion. As will be recognized by those skilled in the art it is not necessary that the connected portions of the chassis 2 include the protrusions such as 2*aa*. Instead, other means can be employed to pivotably connect adjacent connection portions of the chassis 2 including, for example, a gimbal type mount which would enable adjacent connected portions of the chassis 2 to rotate with respect to each other. For example, instead of having an opening formed in the protrusion 2aa the protrusions such as 2*aa* could be shaped so as to snap onto and rotably engage a suitable protrusion formed on the connected portion 2*b*(2). Such an arrangement would eliminate the need for a separate shaft 7. As mentioned above, a gimbal type mount could also be used to pivotably connect adjacent connected portions of the chassis 2.

FIG. 3 is a top view of a portion of the chassis of the present invention. In FIG. 3 it is seen that the protrusion 2aa engages a portion of the connection portion 2b and shaft 7 passes through each of these members so that the adjacent connected portions 2a and 2b can pivot about the shaft 7 and rotate with respect to each other. In the preferred embodiment of the present invention the remaining connected portions of the chassis 2 are pivotably connected to each other in the manner shown in FIG. 3.

Referring to FIG. 1, the drive wheel assembly 4 comprises drive wheel 5, hub 9 and drive gear 9a. The hub 9 is mounted on the drive gear 9a so as to rotate with the drive gear 9a. The combination of the hub 9 and drive gear 9a can be rotatably mounted on the shaft 7. The drive wheel 5 can comprise a natural or synthetic rubber or a material having a large coefficient of friction. The drive wheel 5 is mounted on the hub 9 so that the drive wheel 5 rotates with the drive gear 9a. At least one drive wheel assembly 4 is mounted on each side of the connected portions of the chassis 2 such as illustrated in FIG. 1. As shown in FIG. 1, the rear most connected portion 2e(2) has mounted thereon four drive wheel assemblies wherein the hub 9 is formed to accept two drive wheels 5.

The drive source 3 is preferably housed within the rear most connected portion 2e(2), but can be mounted within any of the connected portions. A power source 10 mounted within, for example, connected portions 2d(2) and 2c(2) comprises, for example, batteries and provides electric power for the drive source 3 through a switch 11. The drive source 3, as well as the batteries 10 are mounted within the connected portions so as to not prevent pivotable rotation of adjacent connected portions of the chassis 2.

The drive force provided by the drive source 3 is transmitted to the drive wheels 5 shown in FIG. 1 through a series of drive gears 9a and transfer gears 12 rotatably mounted on the connected portions of the chassis 2. It will be recognized by those skilled in the art that it is not necessary to transmit the drive force via the use of gears, but that a series of belts and pulleys could be used, or a series of functionally engaging wheels could be employed to transmit the drive force from the drive source 3 to the drive wheels 5.

Figure 2:
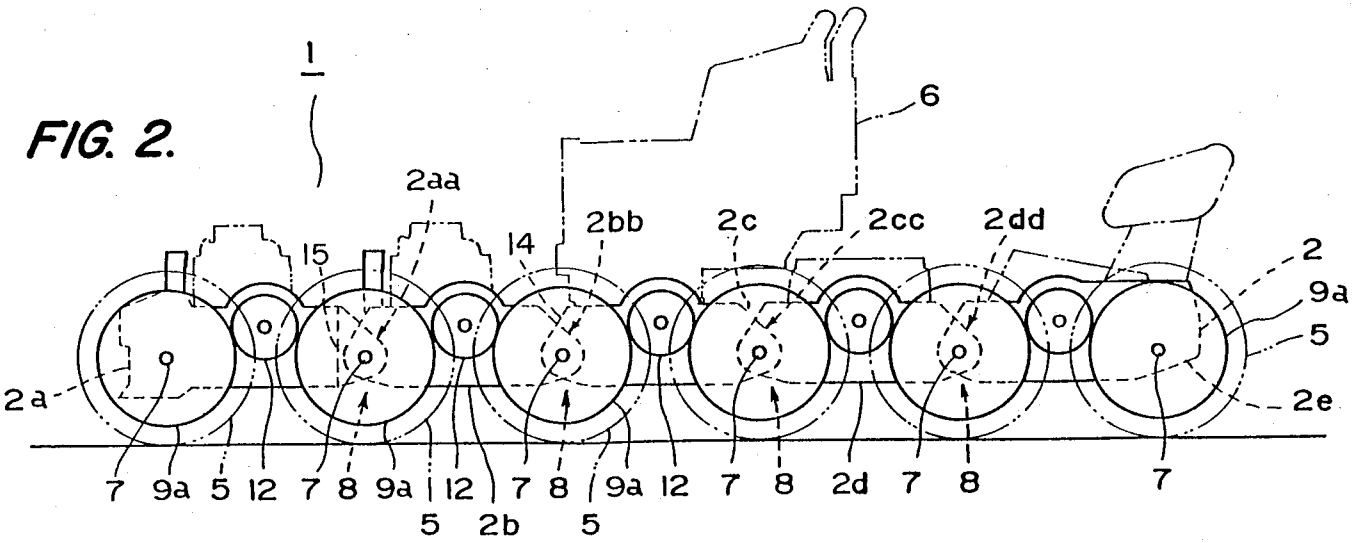
FIG. 2 is a side view of the running toy of the present invention.

As illustrated in FIGS. 1 and 2, the drive gears 9a are mounted for convenience at the pivot point of adjacent connected sections of the chassis 2. For each connected portion of the chassis 2, the transfer gears 12 and the drive gears 9a are rotatably mounted so as to engage each other. In addition, the mounting position of the drive gears 9a and transfer gears 12 on each of the connected portions of the chassis 2 is such that the transfer gear 12 of a connected portion engages the drive gear 9a of an adjacent connected portion. As a result, the drive force of the drive source 3 (transmitted throughs shaft 3' to transfer gear 12 mounted on connected portion 2e(2)) is transmitted to each of the gears rotably mounted on each of the connected portions of the chassis 2. The mounting position of the drive gears 9a and transfer gears 12 on each of the connected portions of the chassis 2 is such that the engagement of a transfer gear 12 of a connected portion with the drive gear 9a of an adjacent connected portion, is independent of the pivotable relationship between the adjacent connected portions of the chassis 2.

Referring to FIG. 1, in a preferred embodiment of the present invention a body 6 having any suitable shape is mounted on the connected portions of the chassis 2. As illustrated, the body 6 has the appearance of a truck driver's compartment and is mounted on the connected portion 2c(2).

Figure 4D:
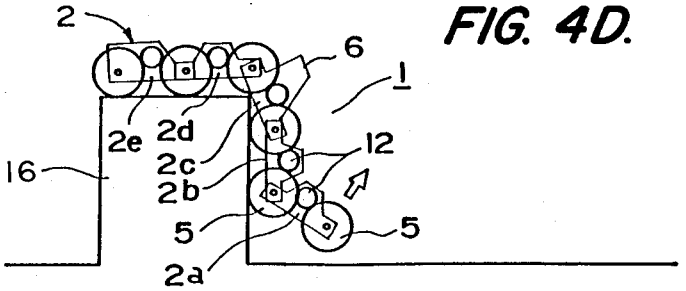
FIGS. 4A–4F schematically illustrate the motion of the running toy according to the present invention.

A spring 13 shown in FIG. 1 is mounted between the connected portions 2a(2) and 2b(2) so as to provide the connected portion 2a(2) with an upward biasing force. This upward biasing force is not necessary, but eases the engagement of the connected portion 2a(2) when descending an obstruction such as illustrated in FIG. 4(D).

Referring to FIG. 1, a front face 14 and a rear face 15 of respective connected portions of the chassis 2 are formed so as to restrict the rotation of the respective connected portions with respect to each other. The rotation can be restricted by forming protrusions on the front face 14 and rear face 15 which act as stoppers for the rotation of the connected portions. Preferably, the connected portions rotate with respect to each other by about a 30° angle in the upward direction and approximately an 80° angle in the downward direction.

The following describes the operation of a running toy in accordance with the present invention. First, the switch 11 is moved so as to connect the power source 10 to the drive source 3, which in the preferred embodiment is a dc motor. The shaft 3' of the dc motor rotates the transfer gear 12 mounted on connected portion 2e(2). Rotation of this transfer gear 12 causes rotation of each of the transfer gears 12, drive gears 9a, as well as the hubs 9 and drive wheels 5. The running toy 1 thus moves along a surface.

Figure 4E:
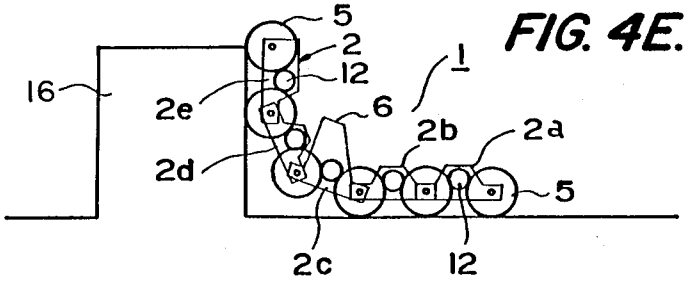
Figure 4F:
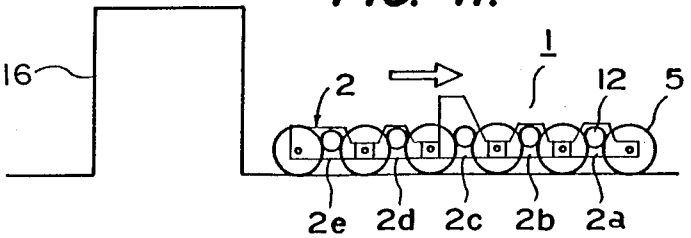
Figure 4A:
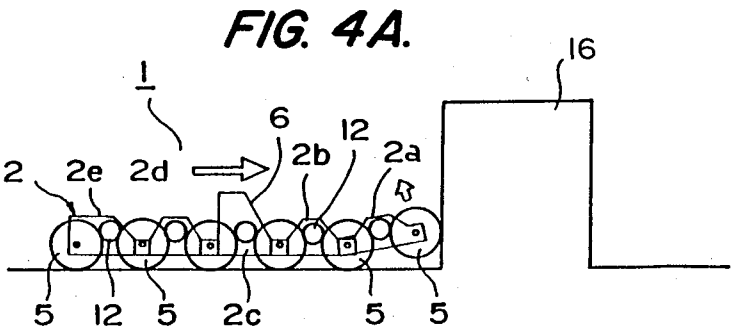
Figure 4B:
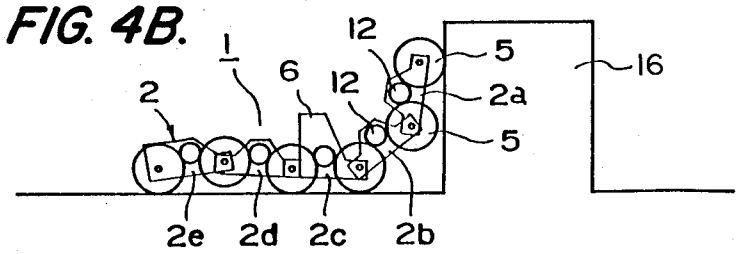
Figure 4C:
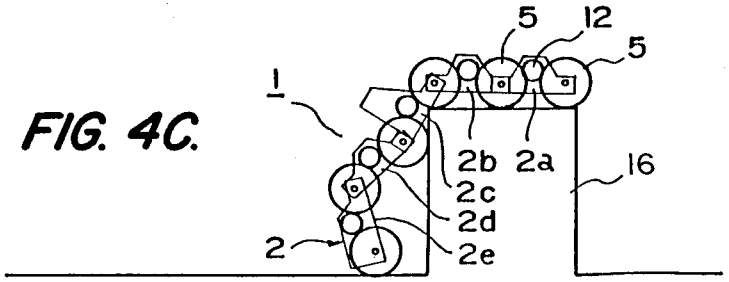

If the front connected portion 2a(2) comes in contact with an obstacle 16 shown in FIG. 4(A), the drive wheels 5 mounted on the connected 2a will tend to ride up the obstacle 16 due to for example, the frictional force between the drive wheels 5 and the obstacle 16 and the driving force provided by the dc motor 3 through each of the transfer gears 12 and drive gears 9a. The running toy 1 is propelled against the obstacle 16 by, for example, the drive wheels 5 of the following connected portions such as 2b and 2c. As a result, the chassis 2 of the running toy 1 will deform as the running toy 1 climbs up and moves over the obstacle 16 as shown in FIGS. 4(B) and 4(C). As the running toy 1 moves over the obstacle 16 as shown in FIGS. 4(C) and 4(D), only those drive wheels in contact with the obstacle 16 (e.g., the drive wheels on connected sections 2a and 2b) provide the force to move the chassis 2 up and over the obstacle 16. As the drive wheels on the subsequent portions of the chassis move the running toy 1 across the top of the obstacle 16, the front most connected portion 2a drops down from the obstacle 16. The spring bias provided by spring 13 (FIG. 1) maintains the connected portion 2a in an inclined position such as shown in FIG. 4(D). The spring bias, however is not necessary, and merely eases the transition of the front portion 2a from a substantially vertical direction to a substantially horizontal direction as shown in FIG. 4(E). FIG. 4(F) illustrates the running toy 1 after climbing over the obstacle 16.

The number and length of the connected portions of the chassis 2 as well as the range of rotation of the respective connected portions of the chassis 2 determine the height and inclination of a obstacle over which the running toy 1 can move.

The running toy of the present invention which comprises a plurality of pivotably connected portions enables a toy to move over an uneven surface and surmount obstacles such that the chassis of the toy deforms to meet the uneven surface of the obstacles. As result the shape of the running toy varies in novel and interesting fashions as it rides over uneven surfaces and obstacles. This variety in shape captures the interest of a user.

What is claimed is:

1. A self-propelled, pivotally running toy for climbing up and over obstacles unassisted by the user, comprising:

(a) a chassis having at least three pivotally connected portions, each including means for limiting the rotation of one portion relative to an adjacent portion to an arc of less than 110 degrees, and two of the pivotally connected portions being the ends of the chassis;

(b) drive means associated with the chassis for providing a drive force;

(c) a plurality of first rotatable axles, each being traversely mounted between, through and pivotally connecting adjacent pivotally connected portions;

(d) a pair of second rotatable axles, each connected to a free end of an end pivotally connected portion;

(e) first and second drive wheels mounted on each end, respectively, of each axle, said first drive wheels being colinear and parallel to said second drive wheels;

(f) drive force transmission means, operatively connected between the drive means and the drive wheels, for transmitting the drive force to the drive wheels independent of the pivotal relationship between respective ones of the pivotally connected portions of the chassis, wherein the drive force transmission means includes (i) a drive gear mounted on each axle, and (ii) a transfer gear rotatably mounted on each pivotally connected portion so as to engage the drive gears mounted on adjacent axles, and (g) a spring biased between an end connected portion and an adjacent connected portion to normally urge said end connected portion at an angle relative to the adjacent connected portion.

2. A self-propelled, pivotally running toy for climbing up and over obstacles unassisted by the user, comprising:

(a) a chassis having at least three pivotally connected portions, each including means for limiting the rotation of one portion relative to an adjacent portion, and two of the pivotally connected portions being the ends of the chassis;

(b) drive means associated with the chassis for providing a drive force;

(c) a plurality of first rotatable axles, each being traversely mounted between, through and pivotally connecting adjacent pivotally connected portions;

(d) a pair of second rotatable axles, each connected to a free end of an end pivotally connected portion;

(e) first and second drive wheels mounted on each end, respectively, of each axle, said first drive wheels being colinear and parallel to said second drive wheels;

(f) drive force transmission means, operatively connected between the drive means and the drive wheels, for transmitting the drive force to the drive wheels independent of the pivotal relationship between respective ones of the pivotally connected portions of the chassis, wherein the drive force transmission means includes (i) a drive gear mounted on each axle, and (ii) a transfer gear rotatably mounted on each pivotally connected portion so as to engage the drive gears mounted on adjacent axles; and (g) a spring biased between an end connected portion and an adjacent connected portion to normally urge said end connected portion at an angle relative to the adjacent connected portion.

3. The toy according to claim 1 or 2, wherein one of the transfer gears is connected to the drive means so as to transfer the drive force to the drive gears and the remaining transfer gears.

4. The toy according to claim 1 or 2, wherein the limiting means comprises corresponding faces formed at each connected portion at the points of connection thereof.

5. The toy according to claim 1 or 2, wherein the limiting means comprises protrusions formed on each connected portion at the points of connection thereof.

* * * * *